US005327761A

United States Patent [19]

Piasecki et al.

[11] Patent Number: 5,327,761

[45] Date of Patent: Jul. 12, 1994

[54] UNIVERSAL ROLLING MILL STAND

[75] Inventors: Josef Piasecki, Essen; Wolfgang Mudersbach, Dinslaken, both of Fed. Rep. of Germany

[73] Assignee: Daniele & C. Officine Meccaniche Spa, Buttrio, Italy

[21] Appl. No.: 21,666

[22] Filed: Feb. 24, 1993

[30] Foreign Application Priority Data

Feb. 26, 1992 [IT] Italy ..... UD92 A 000022
Jun. 17, 1992 [IT] Italy ..... UD92 A 000110

[51] Int. Cl.[5] ..... B21B 13/08
[52] U.S. Cl. ..... 72/225; 72/239
[58] Field of Search ..... 72/237, 225, 248, 239

[56] References Cited

U.S. PATENT DOCUMENTS

| | | | |
|---|---|---|---|
| 3,098,404 | 7/1963 | Morath et al. . | |
| 4,753,097 | 6/1988 | Buchheit | 72/225 |
| 4,918,964 | 4/1990 | Engel et al. | 72/225 |
| 4,932,233 | 6/1990 | Bogendorfer | 72/225 |
| 4,944,175 | 7/1990 | Svagr et al. | 72/225 |

FOREIGN PATENT DOCUMENTS

| | | |
|---|---|---|
| 0103989 | 8/1983 | European Pat. Off. . |
| 0166478 | 5/1985 | European Pat. Off. . |
| 0291719 | 4/1988 | European Pat. Off. . |
| 0298318 | 6/1988 | European Pat. Off. . |
| 0302254 | 7/1988 | European Pat. Off. . |
| 2929423 | 7/1979 | Fed. Rep. of Germany . |
| 88/06930 | 3/1988 | PCT Int'l Appl. . |

OTHER PUBLICATIONS

Pp. 1-8, Cartridge Stands pp. 6-7 FIGS. 15-17, Danieli Company Brochure, Mar. 1986; Buttrio-Udine (IT).

*Primary Examiner*—Lowell A. Larson
*Assistant Examiner*—Thomas C. Schoeffler
*Attorney, Agent, or Firm*—Antonelli, Terry, Stout & Kraus

[57] ABSTRACT

Universal rolling mill stand (10) which comprises a pair of upper (30) and lower (31) rolls having a horizontal axis and defining a rolling plane (13), the rolls (30-31) being complete with their relative chocks (28-29), and comprises also at least one roll (42) having a vertical axis and cooperating with the rolling plane (13), the roll (42) with the vertical axis including its own positioning and guiding chock (38) cooperating with a means (41) that adjusts said chock (38) and includes a pressure screw (63), the rolling mill stand (10) comprising two standards (11) to position and guide the horizontal chocks (28-29), the standards (11) cooperating with a base plate (49), each of the standards (11) including also two housings (14*a*-14*b*) with guides (39) for the chocks (38) of the vertical rolls (42) and also an upper support (24) and lower support (25) as well as two adjustment stay bolts (12), each of said housings (14) having a vertical development with intermediate extensions (55) which define guides (39) and delimit upper and lower first guide surfaces (27), the intermediate extensions (55) constituting means for the positioning and support of the relative adjustment stay bolts (12), the adjustment stay bolts (12) cooperating with the upper (24) and lower (25) supports for their reciprocal positioning, the upper and lower supports (24-25) comprising second guide surfaces (127) cooperating with the first guide surfaces (27), the intermediate extensions (55) cooperating with an intermediate stiffening and positioning housing (43).

12 Claims, 5 Drawing Sheets

UNIVERSAL ROLLING MILL STAND

BACKGROUND OF THE INVENTION

This invention concerns a universal rolling mill stand.

Universal rolling mill stands have the main purpose of producing rolled stock with bent edges and to produce H-beams, I-beams, HIPE sections, etc.

Universal rolling mill stands comprise not only rolls with a horizontal axis but also one or two rolls with a vertical axis positioned respectively either on only one side or on both sides of the rolls with a horizontal axis.

Universal rolling mill stands of the state of the art consist of two monobloc standards connected together at their upper and lower ends by means parallel to the rolls having a horizontal axis.

The chocks which hold the rolls having a horizontal axis and bear the supporting bearings for the rotation of the rolls are positioned between the standards.

The rolls having a vertical axis are installed, instead, on special chocks located between the columns of the standards in an intermediate position between the chocks of the rolls having a horizontal axis.

The rolling mill stands formed in this way are strong, very big and very expensive, entail very long times for changing the rolls and in fact make it impossible to replace the stands themselves quickly. Maintenance work too is complex and takes very long times with considerable plant downtimes.

Rolling mill stands which comprise two pairs of housings anchored to the base plate and acting directly also as vertical guides for the chocks have been proposed to speed up the operations of changing the rolls and of maintenance and to enable the stands to be replaced quickly.

Each pair of housings is associated at its upper and lower ends, by means of two suitable stay bolts, with two cross-heads, a lower cross-head and upper cross-head. These cross-heads can be adjusted towards each other by means of the stay bolts and serve only as a support and abutment for the relative chocks of the rolls having a horizontal axis.

Rolling mill stands of this type entail the drawback that the discharge of the rolling stresses onto the housings causes strains, which may change the trim of the housings and may alter at least the trim of the chocks of the rolls having a horizontal axis owing to the loss of parallelism and alignment that takes place between the guides on which the chocks slide.

These strains are generated by the configuration of the housings and by the type of cooperation obtained between the stay bolts, the housings and the cross-heads.

On the basis of the above, the chocks during working or overloading rest only on one housing and unload thereon all the rolling thrust, while the other housing remains in fact unloaded.

Moreover, the strain generated by the housing under load is translated into a different positioning of the cross-heads, so that the distance between centers of the rolls and, in particular, of the rolls having a horizontal axis is altered and exceeds the tolerance permitted for such processes.

In fact, these strains lead to an alteration of the distance between centers of the upper roll having a horizontal axis and of the lower roll having a horizontal axis.

Furthermore, the rolls having a vertical axis undergo displacements, which are undesirable in themselves and also in relation to the rolls having a horizontal axis and take the processed section out of the permitted tolerance.

Moreover, in the rolling mill stands of the state of the art no devices are included which permit mechanical rough adjustment of the rolls having a vertical axis in combination with a hydraulic system for the continuous adjustment and control of the position of those rolls during the rolling step.

SUMMARY OF THE INVENTION

The present applicants have designed, tested and embodied this invention to overcome the shortcomings of the state of the art and to achieve further advantages.

One purpose of this invention is to provide a universal rolling mill stand which has an economical and functional constructional form and is such that it ensures at the same time that the rolling stresses do not cause displacements or strains of the component parts of the individual standards.

Another purpose is to provide a universal rolling mill stand which enables the rolls, whether they have a vertical or a horizontal axis, to be readily and swiftly changed and the stand itself to be quickly replaced.

A further purpose of the invention is to equip a universal rolling mill stand with a device which can be applied to the rolls having a vertical axis and which is suitable for the positioning of those rolls and for the continuous adjustment and control of those rolls during the rolling step.

The device which adjusts the rolls having a vertical axis and is associated with the universal rolling mill stand according to the invention makes possible a rough adjustment of a mechanical type and a fine adjustment with a simultaneous fine control of a hydraulic type.

According to the invention the rolling mill stand comprises two pairs of vertical housings, each housing having a counterpart intermediate extension; to these intermediate extensions is fitted an adjusting stay bolt, which cooperates with two supports, an upper support and a lower support respectively.

Each upper and lower support respectively cooperates, therefore, with the two housings positioned respectively at the sides; the intermediate extensions of the housings extend between the supports, thus constituting elements to position and support the respective adjustment stay bolts.

These intermediate extensions constitute horizontal guide elements for the relative chock of the roll having a vertical axis.

The assembly consisting of the two vertical housings, the two adjustment stay bolts and the upper and lower respective supports form one of the two standards of the universal rolling mill stand.

The standards are positioned at one side and the other side of the rolling plane with which the set of rolls cooperates.

According to the invention these vertical standards have the task of positioning the relative adjustment stay bolts and of guiding and positioning vertically the chocks of the rolls having a horizontal axis.

An intermediate housing positioned in cooperation with the intermediate extensions extends substantially on a horizontal plane parallel to the rolling plane but at the side thereof and cooperates with the two opposed vertical housings to form an element to stiffen the vertical housings and to support and position the chock of the relative roll having a vertical axis.

Each vertical housing comprises at its outer side positioning and anchorage fins which cooperate with the base plate.

The two supports comprise U-shaped inner seatings which cooperate with the chocks of the two rolls having a horizontal axis and which include guides for the vertical sliding of the chocks and also means for the fine adjustment and control of the positions of the rolls having a horizontal axis during the rolling step. The vertical position of these two supports is adjusted roughly by means of the adjustment stay bolts; these supports can move on the respective inner guides of the relative vertical housings.

By means of this lay-out the rolling stresses are discharged through the respective supports onto both the housings, thus creating one very rigid single whole while retaining extreme simplicity of the components and great ease of assembly and dismantling.

The base plate for each standard consists of a slide block able to move on a trolley, which in turn can be moved on guides.

Clamping and stiffening means are provided when each standard is in the correct working position.

Vertically positionable cradle means are also included and have the task of supporting the set of rolls when the standards are released from the chocks. These cradle means can be moved along the rolling axis to replace one or all of the rolls forming the set of rolls.

The assembly for the rough adjustment of the rolls having a vertical axis according to the invention comprises a motor, which is advantageously a hydraulic motor and drives a worm engaged in an axially bored toothed wheel.

This axial hole in the wheel includes lengthwise grooves circumferentially, of a type with a grooved profile for instance.

A sleeve, which too comprises an external grooved mating profile and an internal threaded female axial bore, cooperates with the axial hole in the wheel.

This internal threaded female axial bore in the sleeve cooperates with a pressure screw so that the toothed wheel, when it rotates, sets in rotation the sleeve, which in any event can move axially.

The sleeve in its rotation about its axis displaces the pressure screw to and fro axially and therewith the supporting chock.

The toothed wheel rotates in a seating, while the sleeve rotates in that seating which, on its side facing the roll, contains guide means for the pressure screw.

This seating at its other side cooperates with a floating piston which can move axially and is supported frontally on the seating.

The pressure screw has at its end a hydraulic-cylinder conformation, which contains a piston solidly fixed to the end of the connecting body that includes the seating.

The floating piston receives oil under pressure at one and/or the other of its faces, thus determining the action which the floating piston exerts through the sleeve on the threaded pressure screw.

The pressures in the two chambers defined in the hydraulic cylinder by the piston positioned therein control the axial movement of the pressure screw.

The set of horizontal and vertical rolls can cooperate with jack means, which are included in the respective chocks and act as shock absorbers between the chocks and as positioning means during the assembly and carriage of the set of rolls.

The assembly and dismantling of the set of rolls take place by removal of the chocks from the relative standards and by displacement of the standards in a direction at a right angle to the rolling axis.

Means for the provisional support of the chocks and other means normally included in rolling mill stands may also be included.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 1:
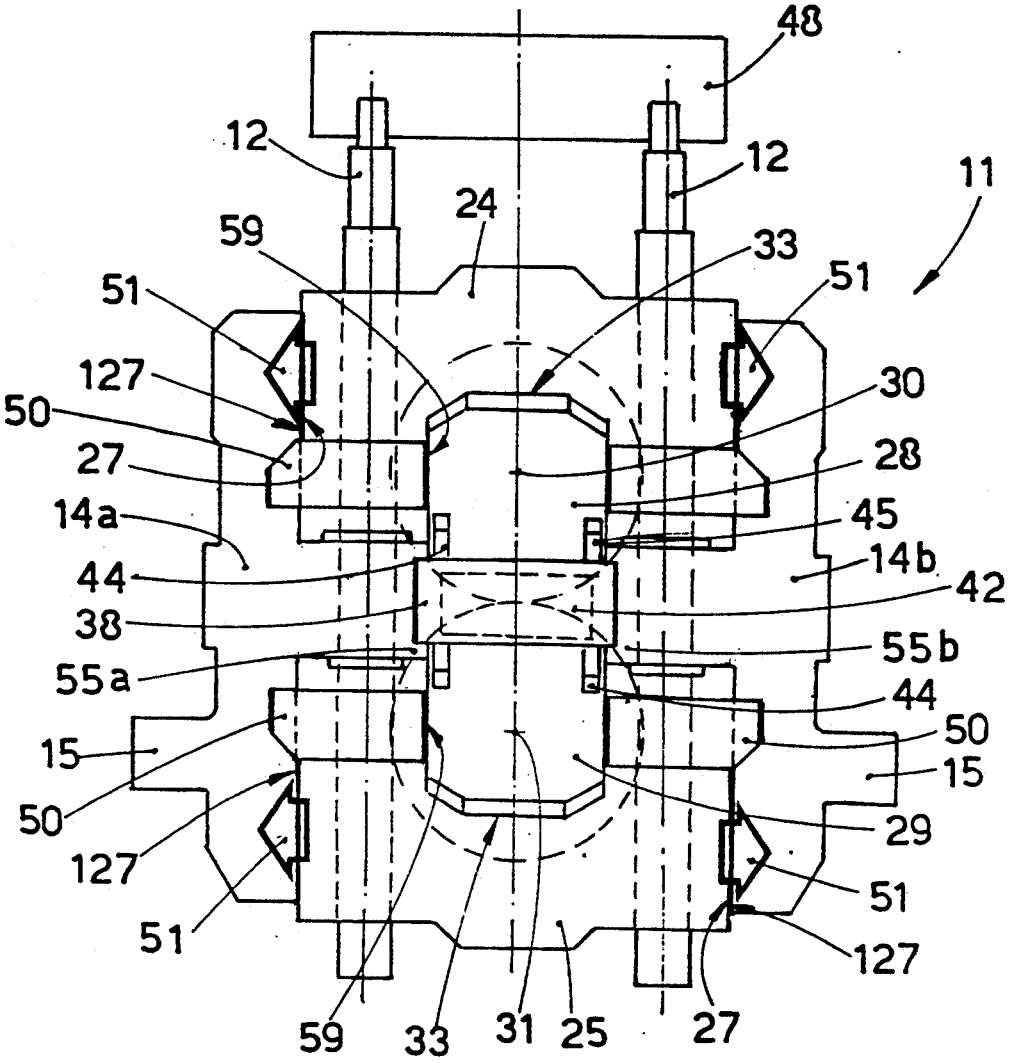
FIG. 1 is a diagrammatic side view of a rolling mill stand according to the invention.
Figure 3:
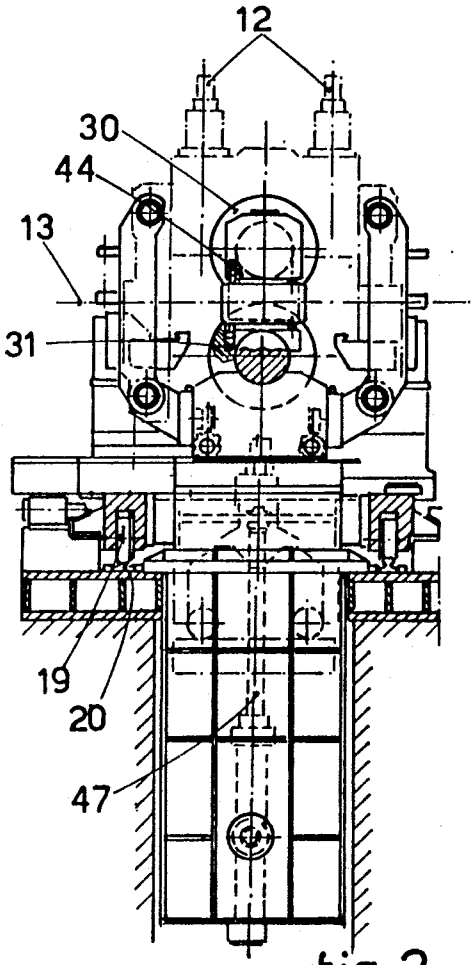
FIG. 3 is a partly cutaway side view of the rolling mill stand according to a vertical plane parallel to the rolling axis.

A universal rolling mill stand 10 according to the invention comprises two vertical standards 11 positioned on each side of the rolling plane 13 and able to move sideways in relation to the rolling plane 13.

Each of the standards 11 consists of a pair of vertical housings **14*a* and 14*b* with outer lateral positioning fins 15, which cooperate with a base plate 49**.

Each vertical housing **14*a*–14*b* includes in an intermediate position an intermediate extension 55*a*–55*b*; these extensions 55*a*–55*b*** are positioned as counterparts to each other.

First guide surfaces 27, which in this case are substantially coplanar, are included above and below the intermediate extensions **55*a*–55*b***.

The intermediate extensions **55*a*–55*b* include means to anchor and position the substantially vertical, through, respective stay bolts 12; there are two adjustment stay bolts 12 for each standard 11**.

The adjustment stay bolts 12 cooperate at their upper ends with an adjustment device 48 which actuates at least two of the four adjustment stay bolts 12 at the same time.

The adjustment device 48 imparts to the adjustment stay bolts 12 a coordinated rotary motion in the same direction, whether clockwise or anticlockwise according to requirements.

The two adjustment stay bolts 12 of each pair cooperate with two supports, an upper support 24 and a lower support 25 respectively, which contain two mating holes 26, in which the two adjustment stay bolts 12 are lodged.

Each support 24–25 in relation to its respective adjustment stay bolt 12 includes a conversion means 56 to convert the rotary motion of the adjustment stay bolt 12 into a vertical movement of the support 24–25.

Each support 24–25 contains second guide surfaces 127 cooperating with the relative first guide surfaces 27 contained in the vertical housings **14*a*–14*b***.

Owing to the action of the adjustment stay bolts 12, therefore, the supports 24–25 can be positioned vertically in relation to the rolling plane 13.

The upper and lower supports 24–25 include at their sides positioning and guide ribs 50, which slide vertically in guides 57, which comprise adjustment cradle means; the guides 57 are integrally fixed to the respective vertical housings **14*a*–14*b***.

According to the invention the standards 11 have the task of positioning the relative adjustment stay bolts 12 and of guiding and positioning the supports 24–25.

The intermediate extensions **55*a*–55*b* bear guides 39 on the rolling plane 13; guide surfaces 32 of the chocks 38 of the relative rolls 42 having a vertical axis cooperate with the guides 39**.

Figure 5:
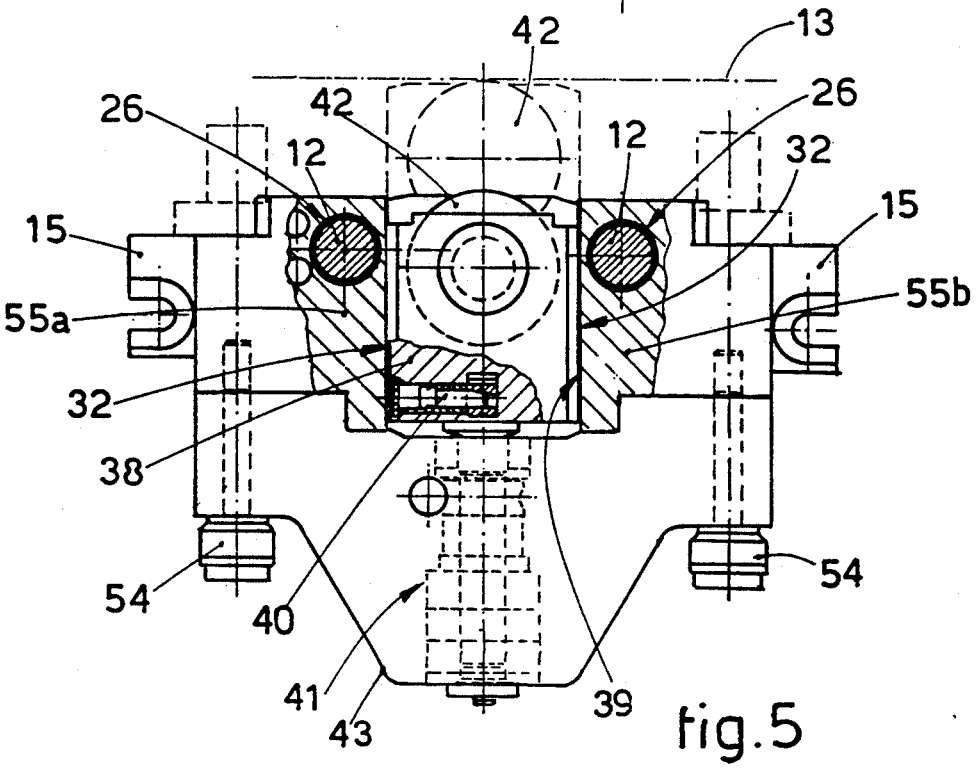
FIG. 5 is a partly cutaway plan view along the line A—A of the detail of FIG. 4, in which is shown the chock supporting the roll having a vertical axis.
Figure 6:
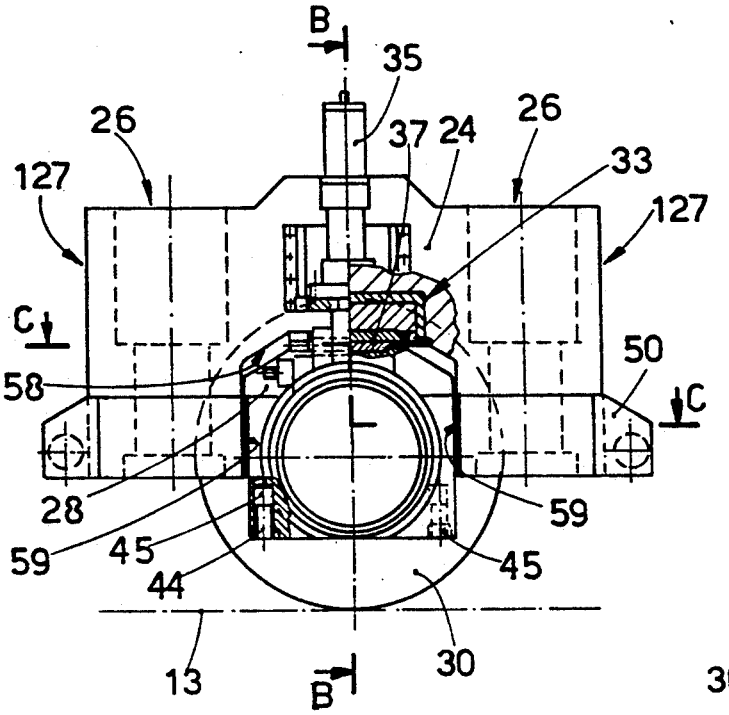
FIG. 6 shows in a still further enlarged scale the chock supporting the upper horizontal roll of FIG. 4.

An intermediate housing 43 (FIG. 5) extending substantially on a horizontal plane parallel to, but at the side of, the rolling plane 13 is included outside the standards 11 themselves and in cooperation with the intermediate extensions **55*a*–55*b* of each standard 11. This intermediate housing 43 connects rigidly the two opposed vertical housings 14 of one standard 11 to form a rigid standard 11 and to support and position the chocks 38 of the relative rolls 42** having a vertical axis.

The upper and lower supports 24–25 respectively contain respective U-shaped mating seatings 58, which include lateral guide surfaces 59 and intermediate adjustment and control means 33.

The U-shaped mating seatings 58 receive and guide vertically the respective upper 28 and lower 29 chocks of the respective upper 30 and lower 31 rolls having a horizontal axis.

The vertical position of the upper and lower supports 24–25 is adjusted roughly by the adjustment stay bolts 12 and the adjustment device 48.

With this lay-out the rolling stresses 51 acting on each horizontal roll 30–31 are discharged by those horizontal rolls 30–31 onto the respective chocks 28 or 29 and thence onto the relative support 24–25 and from the support 24–25 onto the relative housing **14*a* which connects the relative support 24–25 to the adjustment stay bolt 12**.

The rolling stress 51 is transmitted through the support 24–25 to the other adjustment stay bolt 12 too since the supports 24–25 are U-shaped.

The rolling stress 51 is transmitted by the other adjustment stay bolt 12 to the other housing **14*b*, which is supported on the relative supports 24–25**.

Moreover, this configuration enables the reciprocal positions of the chocks 28-29-38 of each standard 11 to be kept unchanged.

The standards 11 are solidly secured to slide blocks 16 by positioning fins 15 included in the housings 14; these slide blocks 16 are actuated by appropriate motive means such as jacks 17 and position the standards 11 properly in relation to the rolling plane 13 and, above all, to the relative chocks 28-29-38.

In the embodiment shown the universal rolling mill stand 10 comprises slide blocks 16 which can be moved on trolleys 18 used for dismantling operations.

The slide blocks 16 can be traversed from a closed working position **16*a* to an open inactive position 16*b*, in which the slide blocks 16 are distanced from the rolling plane 13**, as will be made clear in greater detail in the description that follows.

The slide blocks 16 and trolleys 18 are equipped with clamping means, which are already known and not shown here, so as to be clamped in position when the standards 11 forming the rolling mill stand 10 according to the invention have been properly positioned.

In this example the trolleys 18, being installed on wheels 19 to run on rails 20, enable the universal rolling mill stand 10 to be wholly replaced in a very short time.

The vertical positioning of the chocks 28–29 of the horizontal rolls 30–31 is carried out by positioning the respective supports 24–25 vertically by making the first guide surfaces 27 cooperate with the second guide surfaces 127 of the housings 14.

The continuous adjustment and control of the horizontal rolls 30–31 is effected by means of adjustment and control devices 33 consisting in this example of a hydraulic load cell 37 of a known type.

Figure 7:
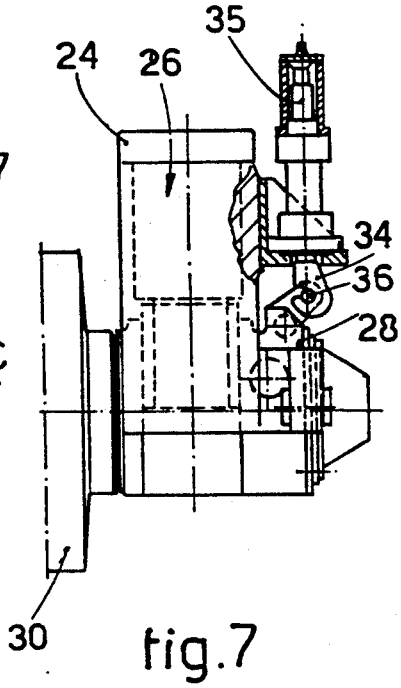
FIG. 7 is a partly cutaway side view, along the line B—B, of the device that attaches and supports the chock supporting the upper horizontal roll of FIG. 6.

In this case (FIG. 7) the upper horizontal roll 30 is supported on each standard 11 by a hook 34 moved by an actuator 35; the hook 34 cooperates with a pin 36 integrally fixed to the supporting chock 28 of the relative upper horizontal roll 30.

Figure 8:
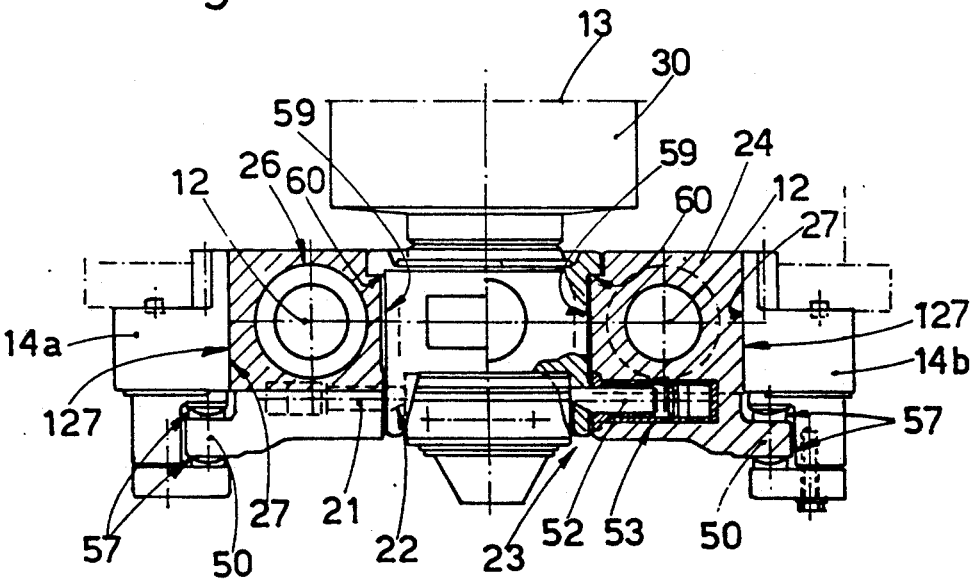
FIG. 8 shows a section, along the line C—C, of the device that attaches and supports the chock supporting the upper horizontal roll of FIG. 6.

Suitably shaped holes 21 with a lead-in 22 are machined in the outer end part of the horizontal chocks 28–29 (FIG. 8); with these holes 21 there cooperate positioning and clamping means 23, which clamp the chocks 28–29 transversely in relation to the relative support 24–25 while permitting a substantially vertical adjusting movement of the chocks 28–29.

In this case the positioning and clamping means 23 consist of locking pins 52 able to move in a seating 53 machined in the support 24–25; these locking pins 52 cooperate momentarily with the mating holes 21 and with an abutment ledge 60.

The vertical chocks 38 can be positioned horizontally on the rolling plane 13 and support their relative vertical rolls 42.

The vertical chocks 38 cooperate by means of their own guide surfaces 32 with lateral guides 39 included on the intermediate extensions **55*a*–55*b* of the housings 14*a*–14*b* and are solidly fixed by a locking pin 40 to adjustment means 41**.

The adjustment means 41 have the task of positioning correctly the vertical chock 38 and therefore the respective vertical roll 42 and of controlling and adjusting the position thereof in relation to the rolling plane 13 during the rolling step.

In this example the adjustment means 41 are fitted to the intermediate housing 43 which, being installed by means of screws 54, holds together the housings 14 constituting the respective standard 11.

Figure 9:
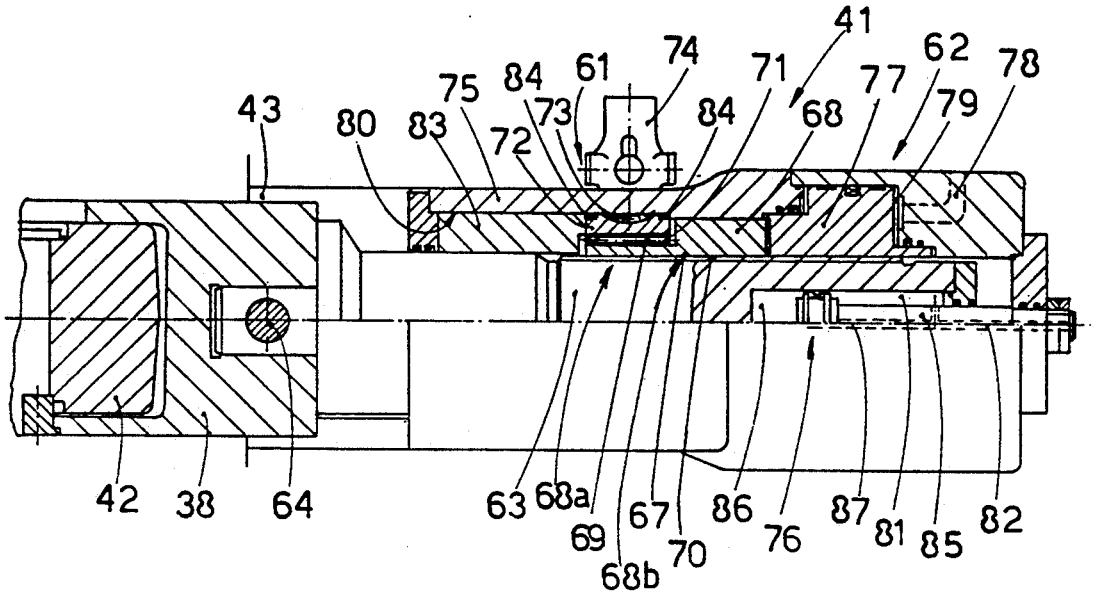
FIG. 9 is a partly cutaway enlarged side view of the device that adjusts a roll having a vertical axis in the universal rolling mill stand according to the invention.
Figure 10:
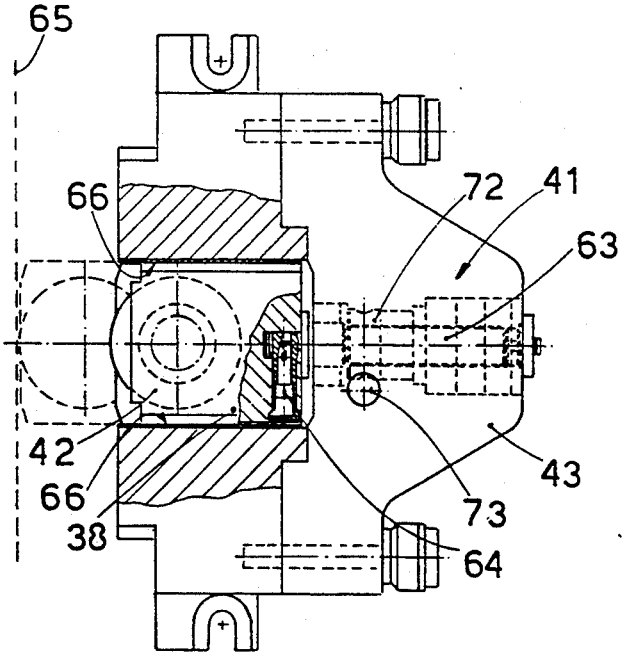
FIG. 10 is a partly cutaway plan view of the adjustment device according to the invention.

The adjustment means 41 comprise in the example of FIGS. 9 and 10 a rough adjustment unit 61 of a mechanical type and a fine adjustment and control unit 62 of a hydraulic type.

A pressure screw 63 acts on the vertical supporting chock 38, to which is fitted, by means of a pivot 64 in this example, the vertical roll 42, which can thus rotate. This pivot 64 enables the vertical supporting chock 38 to be detached from the adjustment means 41.

The vertical supporting chock 38 can move along a substantially horizontal axis at a right angle to the rolling axis 65 so as to enable the vertical roll 42 to be positioned.

The vertical supporting chock 38 is guided laterally by lateral guides 66 in a known manner.

The rear end part of the pressure screw 63 opposite the vertical roll 42 includes a male threaded portion 67, with which a coaxial sleeve 68 cooperates which is axially bored and contains a female threaded portion 70 able to mesh with the male threaded portion 67.

A first part 68*a* of the sleeve 68 facing the vertical roll 42 includes outer lengthwise male grooves of a grooved profile type, whereas the remainder 68*b* of the sleeve 68 is substantially smooth and has a greater diameter; the sleeve 68 can slide axially in its seating.

Mating grooved female profiles 71 contained in the axial bore of the toothed wheel 72 fitted coaxially with the sleeve 68 cooperate with the male lengthwise grooves 69. This toothed wheel 72 can rotate about it own axis but cannot move axially. The sleeve 68 is installed so as to be able to rotate solidly fixed to the toothed wheel 72 but can also move axially.

Bearings 84 are fitted in this case so as to reduce the friction of rotation of the toothed wheel 72 according to the invention.

A worm 73, which in this example is driven by a hydraulic motor 74 fitted to a container 75, meshes with the outer surface of the toothed wheel 72. When the hydraulic motor 74 is actuated, the worm 73 rotates the toothed wheel 72, which in turn sets in rotation the sleeve 68 and makes the pressure screw 63 and therewith the vertical supporting chock 38 of the vertical roll 42 move to and fro axially.

The toothed wheel 72 can rotate in a seating 80, while the sleeve 68 slides in the same seating 80, which in its part facing the vertical roll 42 comprises means 83 for the axial guiding and alignment of the pressure screw 63. The seating 80 at its other end cooperates with the fine adjustment unit 62 of a hydraulic type.

The fine adjustment unit 62 comprises substantially a floating piston 77 able to move axially and supported frontally on the sleeve 68. The floating piston 77 can move axially in a cylindrical hollow 79, which functions as a cylinder and is machined within the container 75.

The cylindrical hollow 79 has a lengthwise extent that enables the floating piston 77 to slide axially by a required length within the hollow 79 so that the fine adjustment of the vertical roll 42 can be performed.

The pressure screw 63 has a terminal and axial cylindrical conformation 76, in which is lodged an axially movable piston 85 solidly fixed to the end of the container 75.

The floating piston 77 receives oil under pressure on one and/or the other of its faces, thus causing the action exerted by the floating piston 77 on the sleeve 68 and thereby on the threaded pressure screw 63. In this case the oil is fed to the floating piston 77 through a conduit 78 connected to a suitable circuit under pressure, which is of a known type and is not shown here.

Two chambers 81–86 of the cylinder 76 receive oil under pressure through appropriate conduits 82–87 and control and adjust the pressure of reaction of the vertical roll 42.

The adjustment of the vertical roll 42 takes place by actuating the hydraulic motor 74, which by rotating the worm 73 sets in rotation the toothed wheel 72 and thus distances or brings nearer the vertical roll 42 from or to the rolling axis 65.

When the threaded pressure screw 63 has been positioned by the rough adjustment unit 61 in the manner described above, the fine adjustment and control unit 62 is actuated and the fine adjustment and control of the vertical roll 42 takes place.

When oil under pressure is injected through the first conduit 78 into the cylindrical hollow 79, the floating piston 77 is displaced axially in the direction of the rolling axis 65 and takes with it the sleeve 68 and pressure screw 63 and therefore the vertical roll 42 or exerts the required pressure on the vertical roll 42.

The fine adjustment has a limited maximum travel, which is equal to the travel of the floating piston 77 in the cylindrical seating 79; this travel is less than the difference in length between the first part 68*a* of the sleeve 68 and the width of the toothed wheel 72.

Against the action of the worm 73 and floating piston 77, the cylinder 76/piston 85 system creates the required opposing force, which prevents sharp, uncontrolled movements of the vertical roll 42.

Jacks 44 cooperate with the lower 29 and upper 28 horizontal chocks and with the vertical chocks 38 and act as shock absorbers between the chocks 28-29-38 and as positioning means during assembly and carriage of the set of rolls 30-31-42.

Figure 2:
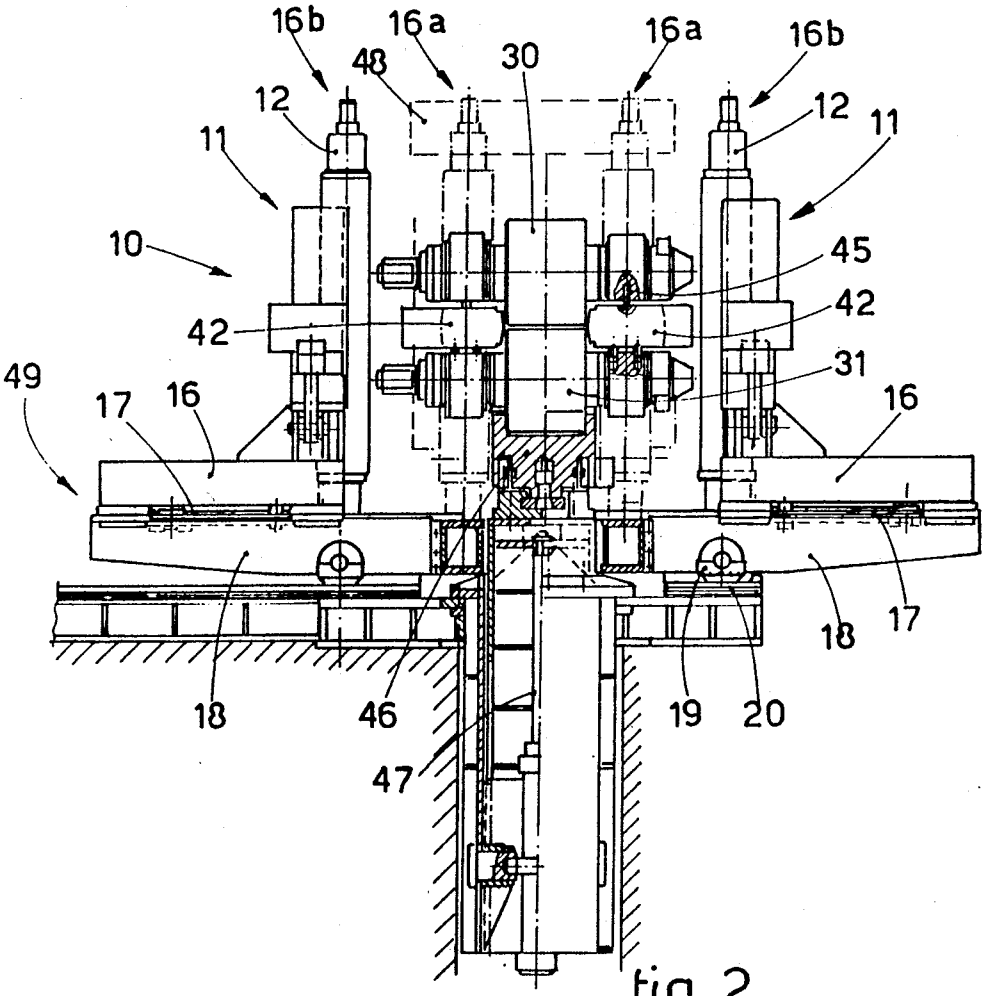
FIG. 2 is a partly cutaway front view, in a direction at a right angle to the rolling axis, of a universal rolling mill stand according to the invention during replacement of the rolls.
Figure 4:
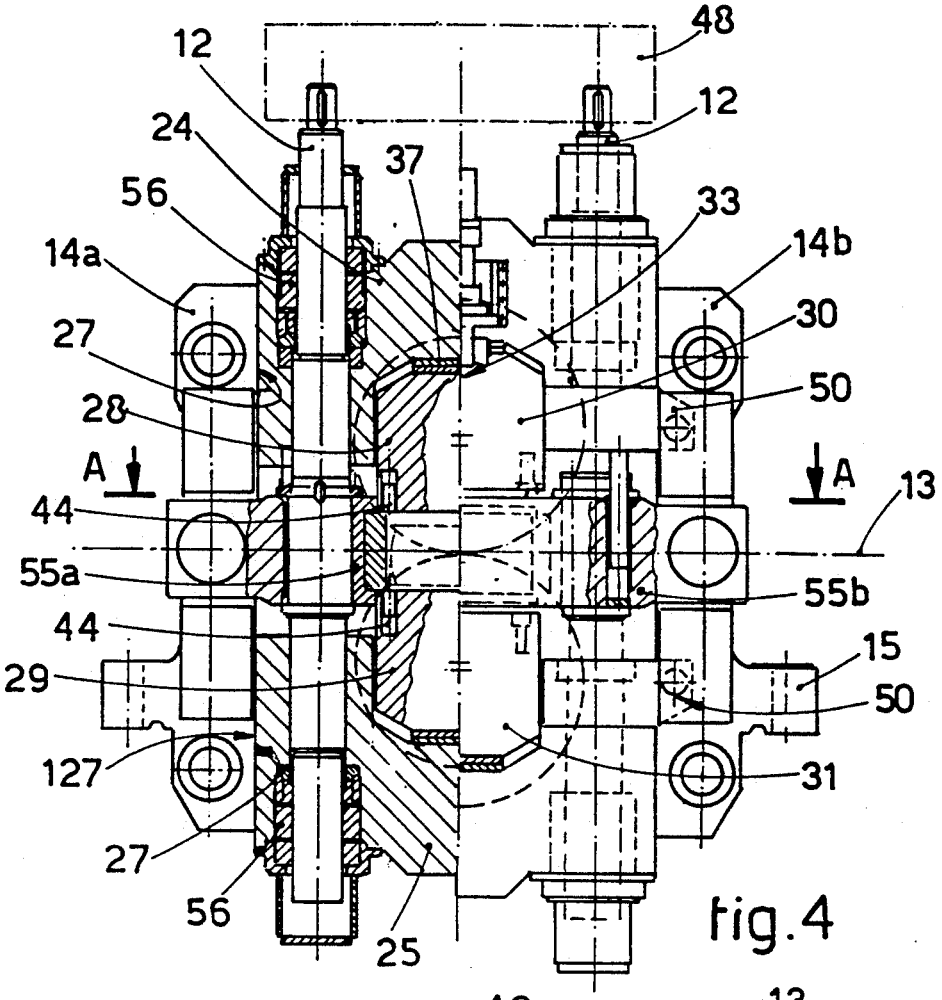
FIG. 4 shows in an enlarged scale a partly cutaway view of the set of horizontal and vertical rolls of FIG. 3.

In this case the end of the jacks 44 cooperates with appropriate seatings 45 machined respectively in the lower face of the upper chocks 28 and in the upper face of the lower chocks 29; these seatings 45 and jacks 44 thus enable one single body to be created between the horizontal rolls 30–31 and vertical rolls 42 (FIG. 2).

The lower horizontal roll 31 is supported on a cradle 46, which can be positioned vertically and moved by an actuator 47 in this example.

In the universal rolling mill stand 10 of the invention the replacement of the horizontal 30–31 and vertical 42 rolls is carried out easily by the following method:

- the adjustment device 48 is released from the adjustment stay bolts 12;
- the cradle 46 which supports the lower horizontal roll 31 is raised by operating the actuator 47;
- the upper horizontal roll 30 is released by acting on the jack 35 that actuates the hook 34;
- the means 41 which adjust the vertical rolls 42 are disconnected from the vertical chocks 38 by removing the locking pin 40;
- the horizontal 30–31 and vertical 42 rolls are now released from the standards 11 and form one single assembly owing to the inclusion of the jacks 44;
- the slide blocks 16 are unclamped and traversed from their working position 16*a* to their inactive position 16*b* until the rolls 30-31-42 are wholly released from the standards 11, the set of rolls 30-31-42 being supported on the cradle 46.

The whole or partial replacement of the rolls 30-31-42 can now take place by traversing the set of rolls 30-31-42 along the lengthwise axis of the rolling plane 13 and replacing that set with another set inserted in the same way.

According to a variant the set of rolls 30-31-42 is removed from above with a bridge crane of a known type not shown here and is replaced by a similar set.

When the new set of rolls 30-31-42 has been positioned, the slide blocks 16 are brought from their inactive position **16*b* to their working position 16*a* and the universal rolling mill stand 10** is set up again by carrying out the above operations in the opposite order.

We claim:

1. A universal rolling mill stand, comprising:

an upper roll and a lower roll each having a horizontal axis, said upper and lower rolls defining a rolling plane therebetween;

a pair of upper chocks and a pair of lower chocks respectively supporting said upper roll and said lower roll;

at least one vertical roll having a vertical rolling axis cooperating with said rolling plane;

at least one positioning and guiding chock for positioning and guiding said at least one vertical roll;

adjustment means including a pressure screw for adjusting a position of said at least one positioning and guide chock;

a base plate;

a pair of standards extending vertically from said base plate spaced from one another in an axial direction of said upper and lower roll; each of said standards comprising a pair of spaced vertically extending housings having intermediate extensions extending horizontally towards one another and delimiting upper and lower first guide surfaces on facing surfaces of said housing respectively above and below said intermediate extensions; an upper support for one of said upper chocks and a lower support for one of said lower chocks extending between said housings, each of said upper and lower supports having opposed second guide surfaces cooperating respectively with said upper and lower first guide surfaces of said housings; a pair of adjustment stay bolts extending vertically through said upper support, said intermediate extension and said lower support for reciprocal vertical positioning of said upper and lower supports; and an intermediate stiffening and positioning housing cooperating with said intermediate extensions; said housings further comprising a guide for said at least one positioning and guiding chock for said at least one vertical roll.

2. A universal rolling mill stand as claimed in claim 1, in which said guide for said at least one positioning and guiding chock comprises facing surfaces of said intermediate extensions of at least one of said standards and in which said adjustment means is fitted to said intermediate stiffening and positioning housing of said at least one standard.

3. Universal rolling mill stand as in claim 1, in which the upper and lower supports include U-shaped facing hollow seatings together with lateral guide surfaces to guide the pair of upper chocks and pair of lower chocks, the seatings including adjustment and control means for fine vertical adjustment of said upper and lower rolls.

4. Universal rolling mill as in claim 1, in which the upper and lower supports comprise positioning and guide ribs, which cooperate with guides solidly fixed to the housings.

5. Universal rolling mill stand as in claim 1, in which the standards are installed on slide blocks movable axially to the horizontal rolls.

6. Universal rolling mill stand as in claim 5, in which the slide blocks are guided substantially by trolleys.

7. Universal rolling mill stand as in claim 1, further comprising a vertically positionable supporting cradle movable vertically from a lower position to a raised position supporting at least said lower roll.

8. Universal rolling mill stand as in claim 7, in which the supporting cradle is movable in a direction along a lengthwise axis of the rolling plane.

9. Universal rolling mill stand as in claim 1, in which the adjustment means comprises a unit for mechanical rough adjustment and a unit for hydraulic fine adjustment, these units being coaxial with the pressure screw.

10. Universal rolling mill stand as in claim 9, in which the pressure screw comprises axially and terminally a cylinder/piston system for preventing sharp uncontrolled movement of said at least one vertical roll.

11. Universal rolling mill stand as in claim 9, in which the unit for mechanical rough adjustment comprises a threaded female sleeve acting on a male threaded portion of the pressure screw and including externally a male grooved segment which cooperates with a toothed wheel containing a mating female grooved segment, the toothed wheel being stationary longitudinally and movable circumferentially through the action of a worm, the sleeve being movable longitudinally.

12. Universal rolling mill stand as in claim 11, in which the unit for hydraulic fine adjustment comprises a floating piston movable within a cylindrical hollow and coaxial with the pressure screw, the floating piston acting on the sleeve.

* * * * *